US010292252B2

(12) United States Patent
Okihira et al.

(10) Patent No.: US 10,292,252 B2
(45) Date of Patent: May 14, 2019

(54) INPUT COUPLER FOR ACCELERATING CAVITY AND ACCELERATOR

(71) Applicant: MITSUBISHI HEAVY INDUSTRIES, MACHINERY SYSTEMS, LTD., Kobe-shi, Hyogo (JP)

(72) Inventors: Kazunori Okihira, Hyogo (JP); Katsuya Sennyu, Hyogo (JP); Ryuichi Matsuda, Tokyo (JP)

(73) Assignee: MITSUBISHI HEAVY INDUSTRIES MACHINERY SYSTEMS, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/062,261

(22) PCT Filed: Feb. 2, 2017

(86) PCT No.: PCT/JP2017/003791
§ 371 (c)(1),
(2) Date: Jun. 14, 2018

(87) PCT Pub. No.: WO2017/135372
PCT Pub. Date: Aug. 10, 2017

(65) Prior Publication Data

US 2019/0008028 A1 Jan. 3, 2019

(30) Foreign Application Priority Data

Feb. 5, 2016 (JP) ..... 2016-020798

(51) Int. Cl.
*H01J 31/26* (2006.01)
*H05H 7/02* (2006.01)
(Continued)

(52) U.S. Cl.
CPC ..... *H05H 7/02* (2013.01); *H01P 1/08* (2013.01); *H05H 7/20* (2013.01); *H05H 2007/025* (2013.01)

(58) Field of Classification Search
CPC .. H05H 1/46; H05H 1/24; H05H 1/54; H05H 1/52; H05H 15/00; H01J 37/32082;
(Continued)

(56) References Cited

U.S. PATENT DOCUMENTS 6,566,667 B1 * 5/2003 Partlo ..... B82Y 10/00 250/493.1
2007/0257766 A1 * 11/2007 Richards ..... B82Y 10/00 337/298
2014/0034239 A1 * 2/2014 Yang ..... H01J 37/32082 156/345.28

FOREIGN PATENT DOCUMENTS

JP H05-129098 A 5/1993
JP H05-304000 A 11/1993
(Continued)

OTHER PUBLICATIONS

PCT/ISA/210, "International Search Report for International Application No. PCT/JP2017/003791," dated Apr. 18, 2017.

*Primary Examiner* — Minh D A
(74) *Attorney, Agent, or Firm* — Manabu Kanesaka; Benjamin Hauptman; Kenneth Berner

(57) ABSTRACT

An input coupler for an accelerating cavity includes a cylindrical external conductor; a cylindrical internal conductor arranged coaxially with the external conductor, inside of which a heating medium circulates; a plate provided between the inner surface of the external conductor and the outer surface of the internal conductor; a cooling part for cooling the plate from the external conductor side to the freezing point of water or lower; and a heat insulating part provided on the part at which the internal conductor and the
(Continued)

plate are connected, the heat insulating part having lower thermal conductivity than that of the internal conductor. The plate is connected to the internal conductor via the heat insulating part.

5 Claims, 6 Drawing Sheets

(51) Int. Cl.
*H05H 7/20* (2006.01)
*H01P 1/08* (2006.01)

(58) Field of Classification Search
CPC ..... H01J 37/32192; H01J 37/32174; H01J 37/32623; H01J 37/08; H01J 37/3171; H01J 27/18; H01J 27/08; H01J 27/14; H01J 41/04; H01J 41/14; H01J 41/06; F03H 1/00; F03H 1/0062; B82Y 10/00; H01T 23/00; H01T 19/00
See application file for complete search history.

(56) References Cited

FOREIGN PATENT DOCUMENTS

| | | | |
|---|---|---|---|
| JP | H06-215898 | A | 8/1994 |
| JP | H07-006897 | A | 1/1995 |
| JP | H11-016699 | A | 1/1999 |
| JP | 3073421 | B2 | 8/2000 |
| JP | 2001-257501 | A | 9/2001 |
| JP | 2014-175133 | A | 9/2014 |

* cited by examiner

INPUT COUPLER FOR ACCELERATING CAVITY AND ACCELERATOR

RELATED APPLICATIONS

The present application is National Phase of International Application No. PCT/JP2017/003791 filed Feb. 2, 2017, and claims priority from Japanese Application No. 2016-020798, filed Feb. 5, 2016, the disclosure of which is hereby incorporated by reference herein in its entirety.

TECHNICAL FIELD

The present invention relates to an input coupler for an accelerating cavity and an accelerator.

BACKGROUND ART

In a superconducting accelerator system, a charged particle beam is directed into an accelerating cavity, and radio frequency electromagnetic waves are introduced via an input coupler. A charged particle in the cavity is accelerated by a radio frequency electric field generated in the cavity. The input coupler introduces into the cavity radio frequency waves generated at a radio frequency generator (e.g., a klystron) and propagated by a waveguide.

There are two types of input couplers: a coaxial coupler; and a rectangular waveguide coupler. PTL 1 discloses an input coupler including a hollow connecting part that continues from an open end of a hollow rectangular part to a cylindrical flange part to integrally connect them. Accordingly, in the invention disclosed in PTL 1, both of the flange part of the input coupler and a flange part of a waveguide are circular, thereby applying a uniform load to a seal member sandwiched by the flange parts. As a result, the sealability is enhanced.

CITATION LIST

Patent Literature

[PTL 1] the Publication of Japanese Patent No. 3073421

SUMMARY OF INVENTION

Technical Problem

An input coupler has one end connected to a waveguide and another end connected to an accelerating cavity. The accelerating cavity is made mainly of niobium and during operation, is kept in vacuum and cooled to substantially 4 K by, e.g., liquid helium, thereby becoming superconducting. At this time, a part of the input coupler connected to the accelerating cavity is also cooled to a very low temperature.

In a coaxial input coupler, an external conductor and an internal conductor are coaxially arranged, and radio frequency waves propagate through its surface. Radio frequency waves generated by a klystron propagate through a waveguide under atmospheric pressure and reach the input coupler. Since the other end of the input coupler is connected to the ultra-high vacuum accelerating cavity in the ultra-high vacuum, a window being a plate-like ceramic member is placed inside the input coupler, for vacuum sealing and radio frequency wave transmission.

The number of the ceramic window placed in the input coupler can be only one in order to seal the vacuum. However, as shown in FIGS. 5, 6, an input coupler 51 may have a double window structure in which two windows 52, 53 are axially placed. Note that the windows 52, 53 are placed between an external conductor 54 and an internal conductor 55 in the input coupler 51. A circulation tube 56 is provided inside the internal conductor 55, and a heating medium flows inside the circulation tube 56. The heating medium passes through an opening 57 of the circulation tube 56 and flows in a space between an inner peripheral surface of the internal conductor 55 and an outer peripheral surface of the circulation tube 56 to cool the internal conductor 55. Note that reinforcement members 58 are provided on respective parts at which the internal conductor 55 and the windows 52, 53 are connected. The heating member flowing in the circulation tube 56 enters and exits spaces between the reinforcement members 58 and the internal conductor 55 via through-holes 59 formed in the respective reinforcement members 58. Note that the reinforcement members 58 may not be provided if the strengths are sufficient.

With the double window structure, it is possible to prevent contamination of foreign matters to accelerating cavity side in assembling and prevent the vacuum from breaking due to damage to one of the windows in use. In the input coupler 51 having the double window structure, the window 52 nearer to the accelerating cavity is cooled to a low temperature (e.g., substantially 80 K), whereas the window 53 nearer to the klystron is maintained at a normal temperature (hereinafter, the window 52 and window 53 are referred to as "low temperature window 52" and "high temperature window 53", respectively). Inside the input coupler 51, a space from the low temperature window 52 toward the accelerating cavity and a space between the low temperature window 52 and the high temperature window 53 are kept in vacuum, whereas a space from the high temperature window 53 toward the klystron is at atmospheric pressure.

As described above, because the accelerating cavity is required to be at a very low temperature during operation, it is necessary to take some measures to reduce the thermal load in the input coupler 51 in order to insulate heat transferred from the input coupler 51 to the accelerating cavity. In an input coupler having one ceramic window, water is circulated through the inside of an internal conductor of the input coupler, and heat generated in an internal conductor can be cooled by water cooling. However, in the input coupler 51 having the double window structure, when water is used as a heating medium circulated through the inside of the internal conductor 55, there is a risk that water will freeze inside the internal conductor 55 at the accelerating cavity side with respect to the low temperature window 52 because the low temperature window 52 is maintained at a very low temperature, substantially 80 K, by liquid nitrogen, or the like. Consequently, the heat generated in the internal conductor 55 is not cooled and is transferred to the external conductor 54 via the low temperature window 52, and thus, heat loss occurs.

For this reason, nitrogen gas or the like is generally used as the heating medium to cool the internal conductor 55. However, since nitrogen gas has a small thermal capacity and provides inefficient cooling performance, cooling by nitrogen gas is limited to when the input radio frequency power is small, i.e., when the input radio frequency power is pulse radio frequency power, or relatively small electric power of continuous wave of radio frequency power. On the other hand, when the input radio frequency power is several tens of kW to substantially 100 kW of continuous wave radio frequency power, there is a problem that the cooling by nitrogen gas is not sufficient.

The present invention has been achieved in light of such a situation, and an object thereof is to provide an input coupler for an accelerating cavity and an accelerator that can prevent an internal conductor from being cooled to the freezing point of water or lower and prevent heat generated in the internal conductor from being transferred to an external conductor, by reducing heat transfer via a plate.

Solution to Problem

In order to solve the above-described problems, an input couple for an accelerating cavity and an accelerator according to the present invention employ the following solutions.

Specifically, an input coupler for an accelerating cavity of the present invention includes: a cylindrical external conductor; a cylindrical internal conductor arranged coaxially with the external conductor, inside of which a heating medium circulates; a plate provided between an inner surface of the external conductor and an outer surface of the internal conductor; a cooling part for cooling the plate from the external conductor side to the freezing point of water or lower; and a heat insulating part provided on a part at which the internal conductor and the plate are connected, the heat insulating part having a lower thermal conductivity than that of the internal conductor, wherein the plate is connected to the internal conductor via the heat insulating part.

According to this structure, radio frequency waves generated by a radio frequency generator propagate through the waveguide and reach an input coupler. Thereafter, the radio frequency waves propagate through surfaces of an external conductor and an internal conductor, thereby introducing the radio frequency waves in an accelerating cavity. A ceramic plate, for example, is provided between an inner surface of the external conductor and an outer surface of the internal conductor, thereby sealing the vacuum at the accelerating cavity side, and the radio frequency wave transmits through the plate. The plate is cooled to the freezing point of water or lower by a cooling part. Since the plate is connected to the internal conductor via an insulating part provided to the internal conductor, heat transfer via the plate is reduced, and therefore it is possible to prevent the internal conductor from being cooled to the freezing point of water or lower. Thus, even when water is used as a heating medium circulating inside the internal conductor, it is possible to reduce or eliminate water freezing inside the internal conductor. In addition, it is possible to prevent heat generated in the internal conductor from being transferred to the external conductor.

In the invention, the heat insulating part includes a vacuum insulation structure internally kept in vacuum.

According to this structure, a connection part connected to the plate, of the heat insulating part, and the heating medium circulating inside the internal conductor are thermally insulated by a space inside the heat insulating part.

In the invention, the heat insulating part includes a bellows provided between the plate and the internal conductor.

According to this structure, during operation, it is possible to prevent a deflection of the internal conductor caused by a thermal expansion difference due to a temperature difference in the heat insulating part when the connection part is cooled.

In the invention, a second plate provided between the inner surface of the external conductor and the outer surface of the internal conductor is further provided, the second plate being different from the aforementioned plate, wherein a space between the aforementioned plate and the second plate is kept in vacuum.

According to this structure, two plates, a first plate and the second plate, are axially placed inside the input coupler, and therefore it is possible to prevent contamination of foreign matters to the accelerating cavity side in assembling and prevent the vacuum from breaking even when one of the first plate and the second plate is damaged in use.

An accelerator according to the present invention includes an accelerating cavity provided with the above-described input coupler for the accelerating cavity.

Advantageous Effects of Invention

According to the present invention, a heat transfer via a plate is reduced, and therefore it is possible to prevent an internal conductor from being cooled to the freezing point of water or lower and to prevent heat generated in the internal conductor from being transferred to an external conductor.

DESCRIPTION OF EMBODIMENTS

Hereinafter, a superconducting accelerator system according to an embodiment of the present invention will be described with reference to the drawings.

Figure 4:
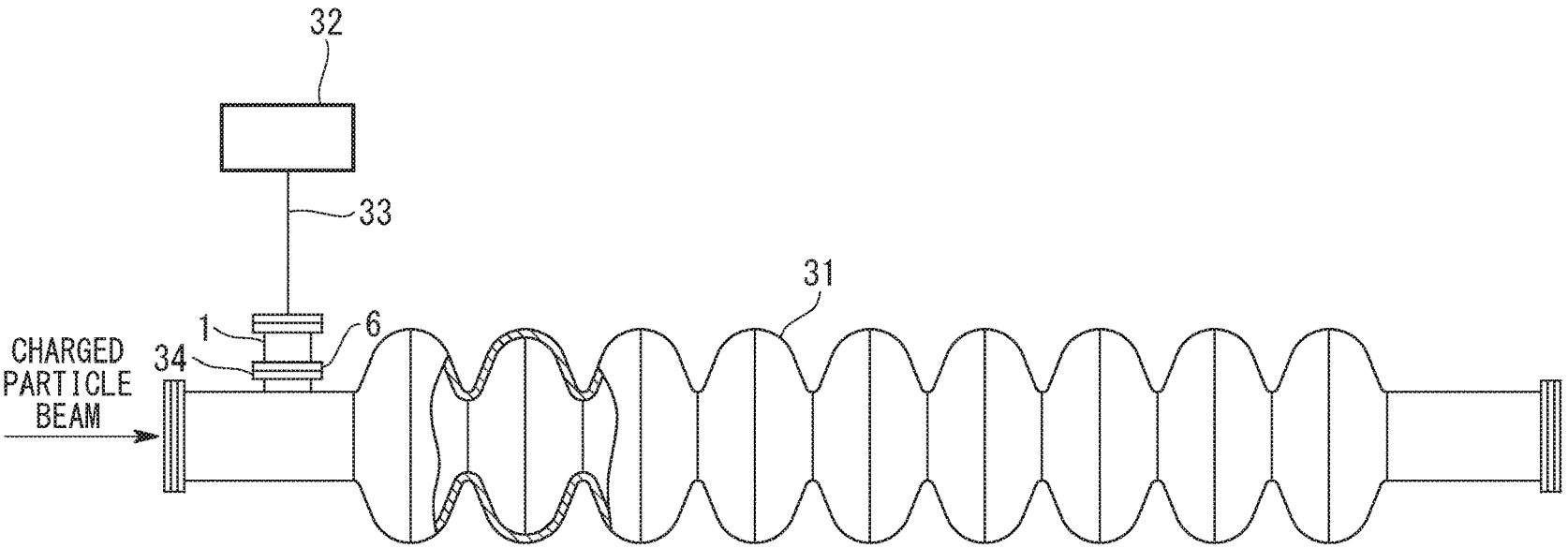
FIG. 4 is a schematic diagram showing a super conducting accelerator system according to the embodiment of the present invention.
Figure 5:
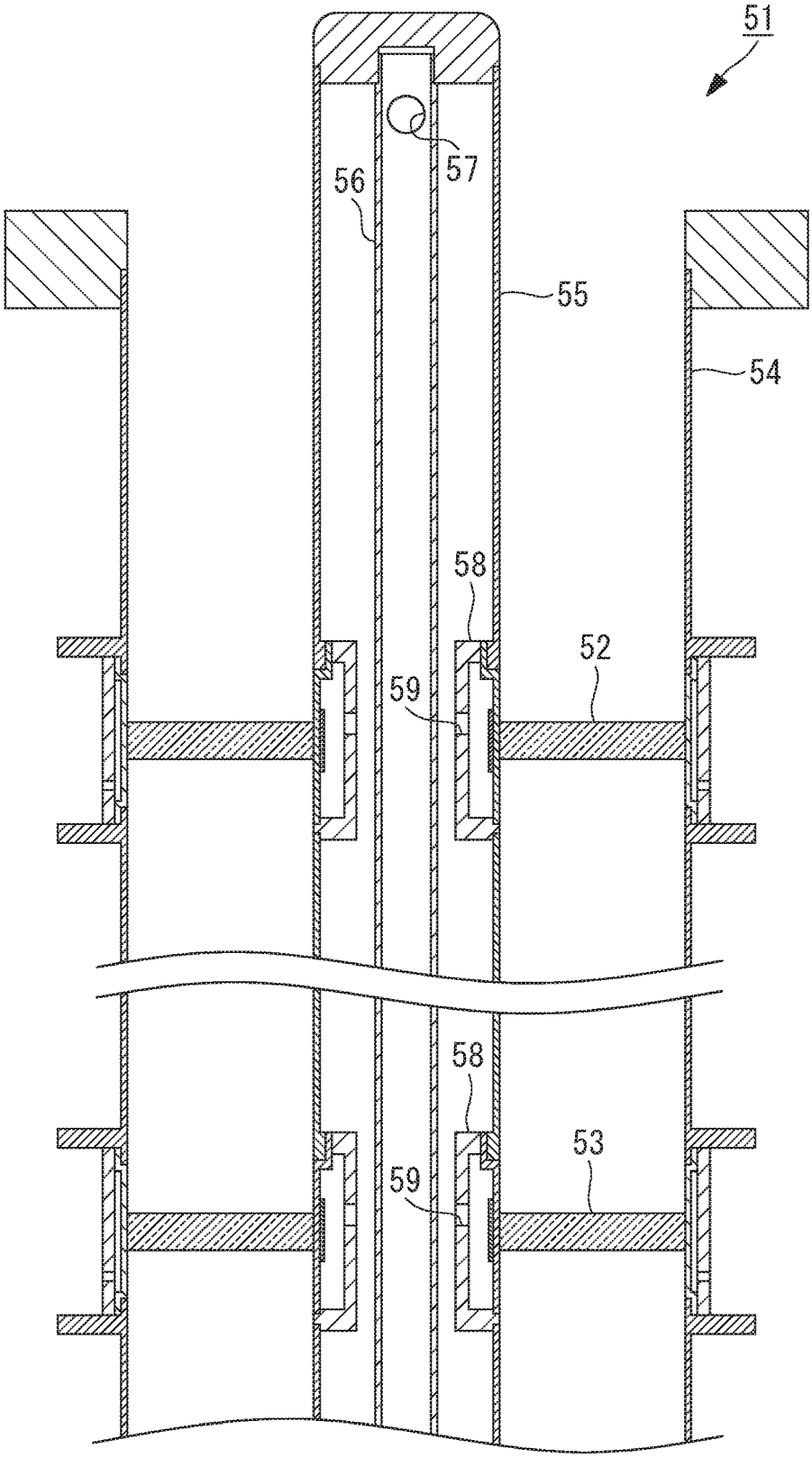
FIG. 5 is a longitudinal sectional view showing a conventional input coupler.
Figure 6:
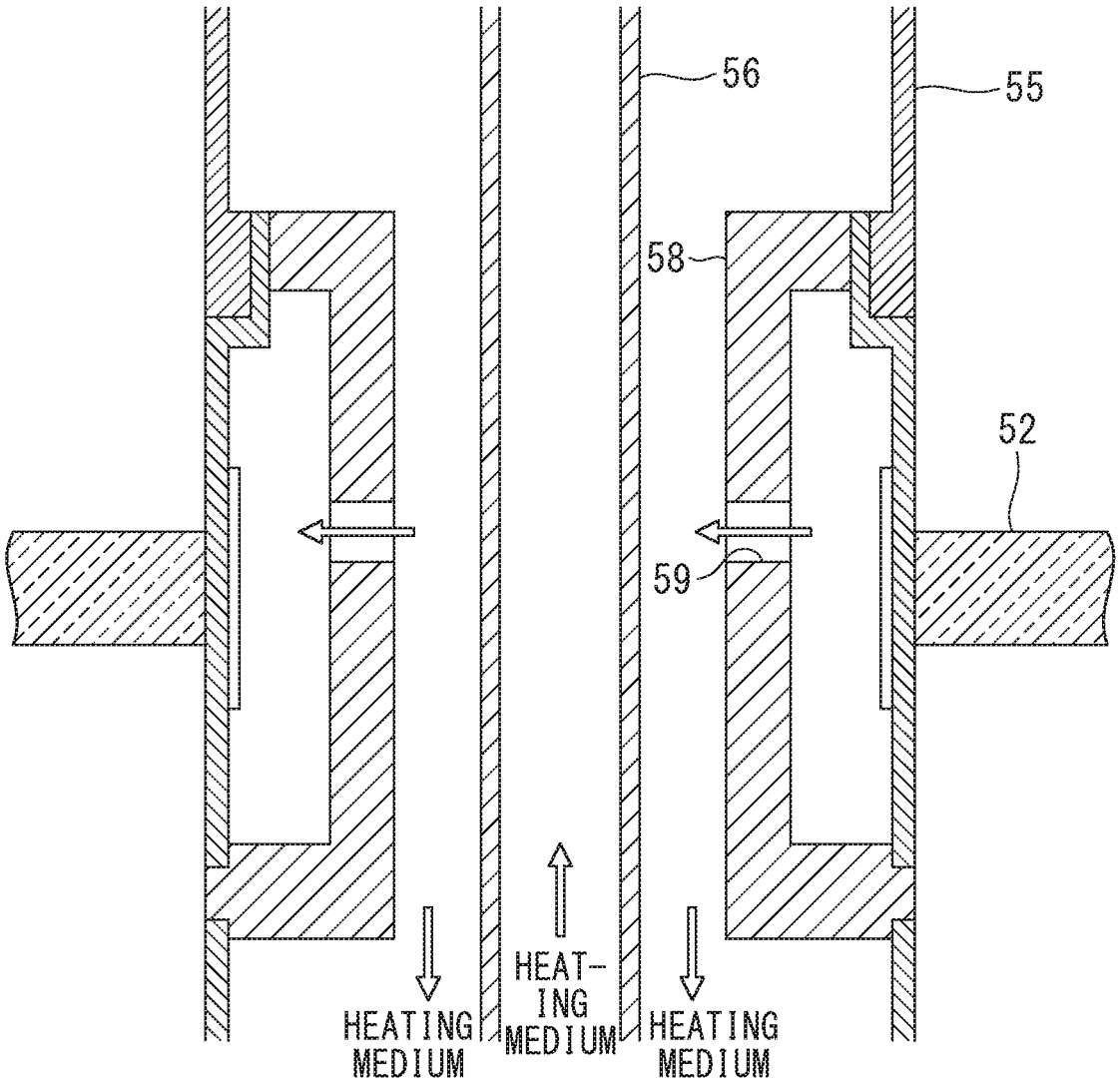
FIG. 6 is a partial enlarged longitudinal sectional view showing the conventional input coupler.

As shown in FIG. 4, in the superconducting accelerator system, a charged particle beam is directed into an accelerating cavity 31, and radio frequency electromagnetic waves are introduced via an input coupler 1. A charged particle in the accelerating cavity 31 is accelerated by a radio frequency electric field generated in the accelerating cavity 31. The input coupler 1 is connected to the accelerating cavity 31 and introduces, into the accelerating cavity 31, a radio frequency wave generated by a radio frequency generator 32 (e.g., a klystron) and propagated through a waveguide 33.

Figure 1:
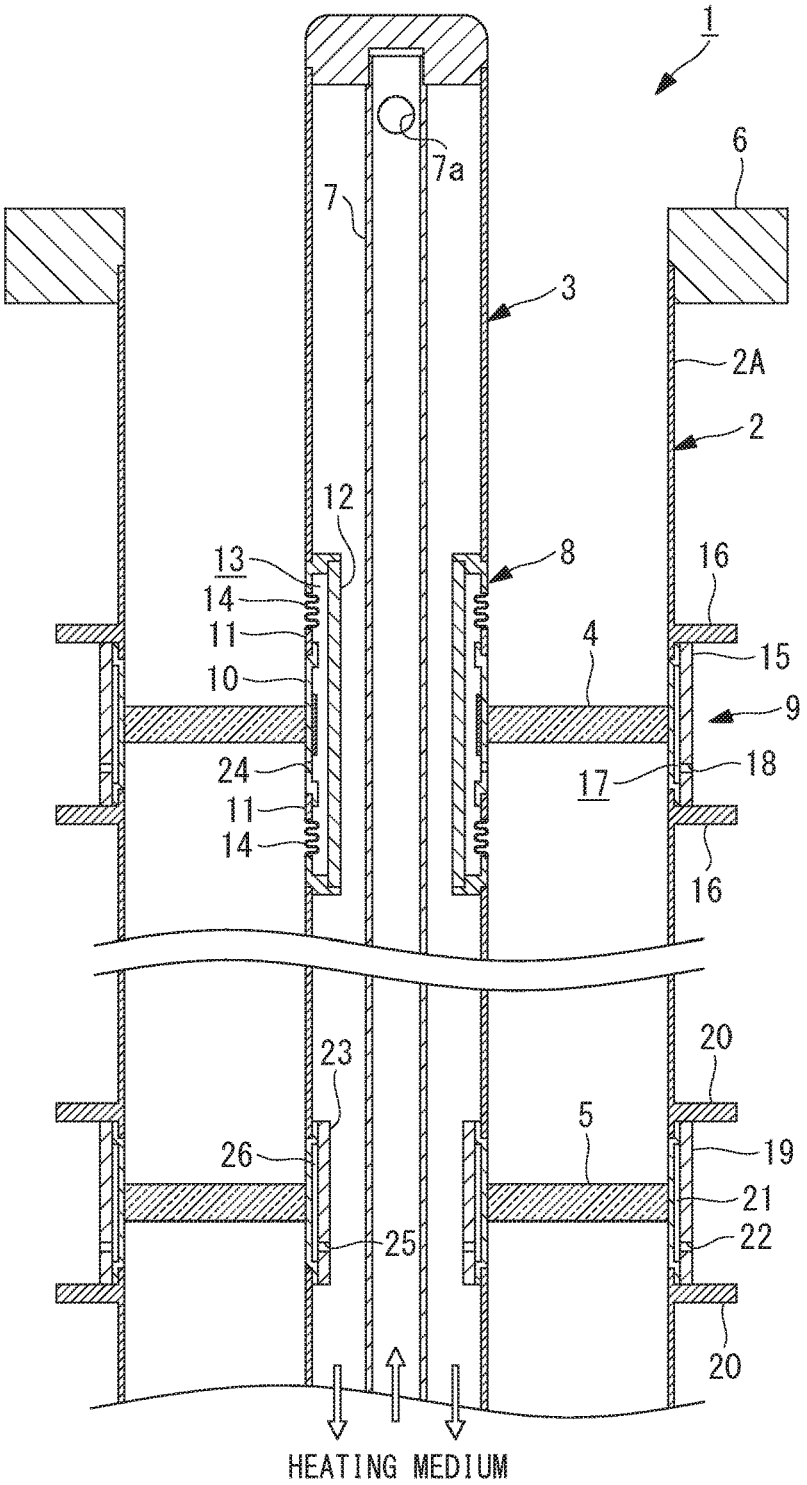
FIG. 1 is a longitudinal sectional view showing an input coupler according to an embodiment of the present invention.
Figure 2:
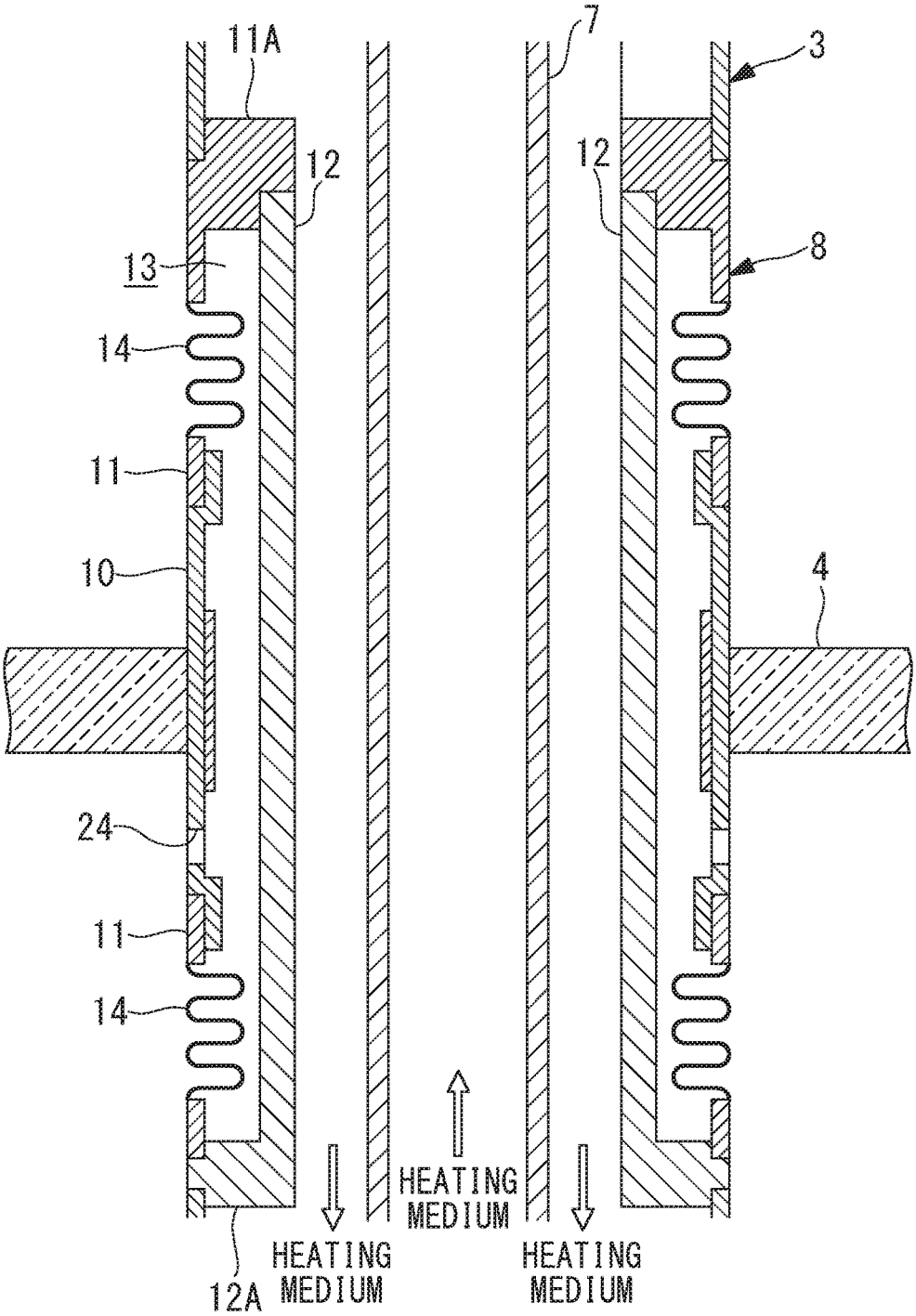
FIG. 2 is a partial enlarged longitudinal sectional view showing the input coupler according to the embodiment of the present invention.

The input coupler 1 according to the embodiment is applied to a so-called coaxial coupler. The input coupler 1 has one end connected to the accelerating cavity 31 and another end connected to the waveguide 33. As shown in FIGS. 1, 2, the input coupler 1 includes an external conductor 2, an internal conductor 3, a first plate 4, and a second plate 5.

The external conductor 2 has a cylindrical shape and has one end connected to the accelerating cavity 31 and another end connected to the waveguide 33. At the one end of the external conductor 2, provided is a flange 6 having an outer diameter larger than that of a main body part 2A of the external conductor 2. The flange 6 of the external conductor 2 is connected to a flange 34 (see FIG. 4) provided on the accelerating cavity 31 by, for example, bolting. During operation of the superconducting accelerator system, the accelerating cavity 31 is cooled to substantially 4 K by, for example, liquid helium and becomes superconducting, and the flange 6 as well is at substantially 4 K.

The external conductor 2 is made of stainless steel, for example, and copper plating is performed on its surface. Stainless steel is applied because it is usable either at a low temperature or at a high temperature and a magnetic field is not easily generated due to its low magnetic susceptibility. Further, in stainless steel, copper plating is easily performed, and brazing is also easily performed. Examples of stainless steel include SUS316L and SUS304.

The internal conductor 3 is arranged coaxially with the external conductor 2 such that a central axis of the external conductor 2 coincides with a central axis of the internal conductor 3. The one end of the internal conductor 3 is extended to a position protruding from the one end of the external conductor 2, on which the flange 6 is provided.

The entire part of the internal conductor 3 is made of oxygen-free copper, except for a heat insulating part 8 described below. As described below, the heat insulating part 8 is made of stainless steel, and copper plating is performed on its surface facing the external conductor 2.

A heating medium circulates inside the internal conductor 3. The heating medium removes heat generated in the internal conductor 3 during operation and reduces temperature rise in the internal conductor 3. A circulation tube 7 is placed along an axial direction inside the internal conductor 3. The circulation tube 7 has one end connected to the one end of the internal conductor 3 and an opening 7*a* is formed near the one end of the circulation tube 7. The heating medium circulates inside the circulation tube 7 from the waveguide side, passes through the opening 7*a*, and is supplied to a space between an inner peripheral surface of the internal conductor 3 and an outer peripheral surface of the circulation tube 7. Thereafter, the heating medium is discharged to the waveguide 33 side while removing heat of the inner peripheral surface of the internal conductor 3. Note that the one end of the circulation tube 7 may not be connected to the one end of the internal conductor 3, and in that case, the one end of the circulation tube 7 serves as an opening through which the heating medium passes.

The heating medium is, for example, water. According to the embodiment, since the heat insulating part 8 is provided, it is possible to prevent temperature of the internal conductor 3 from becoming the freezing point of water or lower due to the first plate 4 cooled from the external conductor 2 side, and thereby it is possible to reduce or eliminate water freezing inside the internal conductor 3. Note that the heating medium applied in the present invention is not limited to water, and a material having the melting point or the pour point lower than that of water is applied as a heating medium, for example, and thereby it is possible to further reduce or eliminate the heating medium freezing inside the internal conductor 3.

Examples of a material usable as the heating medium except water include ethylene glycol (e.g., boiling point: 197° C. or lower, melting point: −13° C. or lower), a material mainly composed of fluorocarbon such as Fluorinert™ (e.g., boiling point: 90° C. or lower, pour point: −110° C. or lower), and a perfluoropolyether (PFPE) such as Galden® (e.g., boiling point: 130° C. or lower, pour point: −100° C. or lower). These materials not only have the melting points or the pour points lower than the melting point of water and are not easily frozen inside the internal conductor 3, but also have relatively high boiling points and are not easily vaporized by heat generated in the internal conductor 3.

The first plate 4 and the second plate 5 are plate-like members made of ceramic such as aluminum oxide ($Al_2O_3$). The first plate 4 and the second plate 5 seal the vacuum of the accelerating cavity 31 side and the first plate 4 and the second plate 5 transmit the radio frequency waves therethrough. The first plate 4 and the second plate 5 are not limited to ceramic plates and may be made of other materials as long as they can seal the vacuum of the accelerating cavity 31 side and transmit the radio frequency waves therethrough. The first plate 4 and the second plate 5 are separated from each other and are arranged such that their plate surfaces are perpendicular to the axial direction of the input coupler 1. The first plate 4 is provided nearer to one end side of the input coupler 1, the one end being connected to the accelerating cavity 31, whereas the second plate 5 is provided nearer to another end side of the input coupler 1, the other end being connected to the waveguide 33. Each of the first plate 4 and the second plate 5 has a circular shape, and the entire circumference of an outer peripheral end is connected to the inner surface of the external conductor 2, and the entire circumference of an inner peripheral end is connected to the outer surface of the internal conductor 3.

The accelerating cavity 31 side of the input coupler 1 is opened, and between the external conductor 2 and the internal conductor 3, a space from the first plate 4 toward the accelerating cavity 31 as well is kept in vacuum by maintaining the vacuum of the accelerating cavity 31. A space between the first plate 4 and the second plate 5 is formed into a closed space jointly with the external conductor 2 and the internal conductor 3, and air is discharged via through-holes provided in the external conductor 2, and therefore the space is kept in vacuum. The waveguide 33 side of the input coupler 1 is opened, and between the external conductor 2 and the internal conductor 3, a space from the second plate 5 toward the waveguide 33 is at atmospheric pressure.

The first plate 4 or the second plate 5 and the external conductor 2 or the internal conductor 3 are joined by brazing. Note that the brazing material is gold, for example. During operation of the superconducting accelerator system, the first plate 4 is cooled to, e.g., substantially 80 K, whereas the second plate 5 is maintained at a normal temperature (e.g., substantially 300 K).

Two plates, the first plate 4 and the second plate 5, are axially placed inside the input coupler 1, and thereby the input coupler 1 has a double window structure. This makes it possible to prevent contamination of foreign matters to the accelerating cavity 31 side in assembling and prevent the vacuum from breaking even when the first plate 4 or the second plate 5 is damaged in use.

A jacket part 9 is provided on the part at which the external conductor 2 and the first plate 4 are connected in order to cool the first plate 4 and reinforce the external conductor 2 joined to the outer peripheral surface of the first plate 4. The jacket part 9 has a structure in which the heating medium such as liquid nitrogen is supplied and therefore is capable of cooling the first plate 4 from the external conductor 2 side. The jacket part 9 includes a cylindrical part 15 surrounding the external conductor 2 and annular parts 16 provided at respective ends of the cylindrical part 15, for example. The annular parts 16 are provided to extend in a radial direction from the outer peripheral surface of the external conductor 2, and liquid nitrogen is supplied to a space 17 defined by the outer peripheral surface of the external conductor 2, the cylindrical part 15, and the annular parts 16. Even when the heating medium such as liquid nitrogen is not supplied directly into the jacket part 9, the first plate 4 can be cooled from the outside of the external conductor 2 by providing, on the respective annular parts 16, thermal anchors having a temperature substantially the same as the temperature of the heating medium. In the cylindrical part 15, a through-hole 18 through which liquid nitrogen flows is formed. The cylindrical part 15 is provided along the external conductor 2, and the annular parts 16 are connected to the outer surface of the external conductor 2, and thereby the part at which the external conductor 2 and the first plate 4 are connected is reinforced.

The heat insulating part 8 is provided on a part at which the internal conductor 3 and the first plate 4 are connected.

Since the heat insulating part 8 is provided, it is possible to prevent the temperature of the internal conductor 3 from decreasing to the freezing point of water or lower by heat transfer, and also prevent the heat generated in the internal conductor 3 from being transferred to heat the external conductor 2, even when the heating medium circulated through the inside of the internal conductor 3 is water, and the first plate 4 is cooled to a temperature lower than the freezing point of water. When the heating medium is not water, as well, it is also possible to prevent the temperature of the internal conductor 3 from decreasing to the freezing point of the heating medium or lower since the heat insulating part 8 is provided.

The heat insulating part 8 forms a vacuum space in such a manner as to surround the part at which the first plate 4 and the internal conductor 3 are connected.

The heat insulating part 8 includes a connection part 10 connected to the first plate 4 and low thermally conductive parts 11 provided at respective ends of the connection part 10, and a cylindrical part 12 having a diameter smaller than that of the inner peripheral surface of the internal conductor 3 and provided around the connection part 10. The connection part 10, the low thermally conductive parts 11, and the cylindrical part 12 that constitute the heat insulating part 8 are made of stainless steel. Further, the outer peripheral surface of the internal conductor 3, i.e., surfaces on the external conductor 2 side of the connection part 10 and the low thermally conductive parts 11 are copper plated.

The connection part 10 is a cylindrical member. An outer surface of the connection part 10 is connected to the inner peripheral end of the first plate 4 by brazing.

The low thermally conductive parts 11 are provided one on each end of the connection part 10. The low thermally conductive parts 11 are cylindrical members made of stainless steel. Annular parts 11A, 12A provided on ends, of the heat conductive parts 11, on the opposite side of the ends to which the connection part 10 is connected are connected to other copper-made cylindrical parts of the internal conductor 3. As a result, the connection part 10 connected to the first plate 4 and the other cylindrical parts are thermally insulated by the low thermally conductive parts 11.

As shown in FIG. 2, the annular part 11A extending in a radial direction of the internal conductor 3 is formed, at a position near the end of one of the low thermally conductive parts 11, on an inner surface of the low thermally conductive part 11. Also, as shown in FIG. 2, the annular part 12A extending in the radial direction of the internal conductor 3 is formed, at a position near an end of the cylindrical part 12, on an outer surface of the cylindrical part 12.

The cylindrical part 12 is made of stainless steel, for example, and connected to the two low thermally conductive parts 11 via the respective annular parts 11A, 12A. Thus, a closed space 13 is formed by the connection part 10, the low thermally conductive parts 11, and the cylindrical part 12. The space 13 is kept in vacuum during operation. To keep space 13 in vacuum, a through-hole 24 is formed between the first plate 4 and the second plate 5 in the connection part 10. By providing the through-hole 24 at this position, contamination in the accelerating cavity 31 can be prevented compared to when the through-hole 24 is formed at a position on the accelerating cavity 31 side with respect to the first plate 4.

The cylindrical part 12 is placed along the internal conductor 3, and the annular parts 11A, 12A are connected to the inner surface of the internal conductor 3, and thereby the part at which the internal conductor 3 and the first plate 4 are connected is reinforced.

Although a case where the annular part 11A is provided on one end of one of the low thermally conductive parts 11 and the annular part 12A is provided on one end of the cylindrical part 12 is described in the example shown in FIGS. 1, 2, the present invention is not limited to this example. For example, the annular part 12A may not be formed on the cylindrical part 12 and the annular part 11A may be formed on each of the two low thermally conductive parts 11 and connected to the cylindrical part 12. Alternatively, the annular part 11A may not be formed on the low thermally conductive part 11 and the annular part 12A may be provided on both ends of the cylindrical part 12.

The heating medium does not flow in the space 13 and the space 13 is kept in vacuum, thereby thermally insulating the connection part 10 connected to the first plate 4 and the heating medium inside the internal conductor 3 by the space 13.

A bellows 14 is provided on a central portion in the axial direction of each of the low thermally conductive parts 11. The bellows 14 is thinner than other parts of the low thermally conductive parts 11 and has a plurality of bending shapes. The bellows 14 is made of stainless steel and copper plating is performed on an outer peripheral surface of the bellows 14, i.e., a surface on the external conductor 2 side of the bellows 14. During operation, the bellows 14 can prevent a deflection of the internal conductor 3 caused by a thermal expansion difference due to a temperature difference between the bellows 14 and the cylindrical part 12 when the connection part 10 is cooled.

Figure 3:
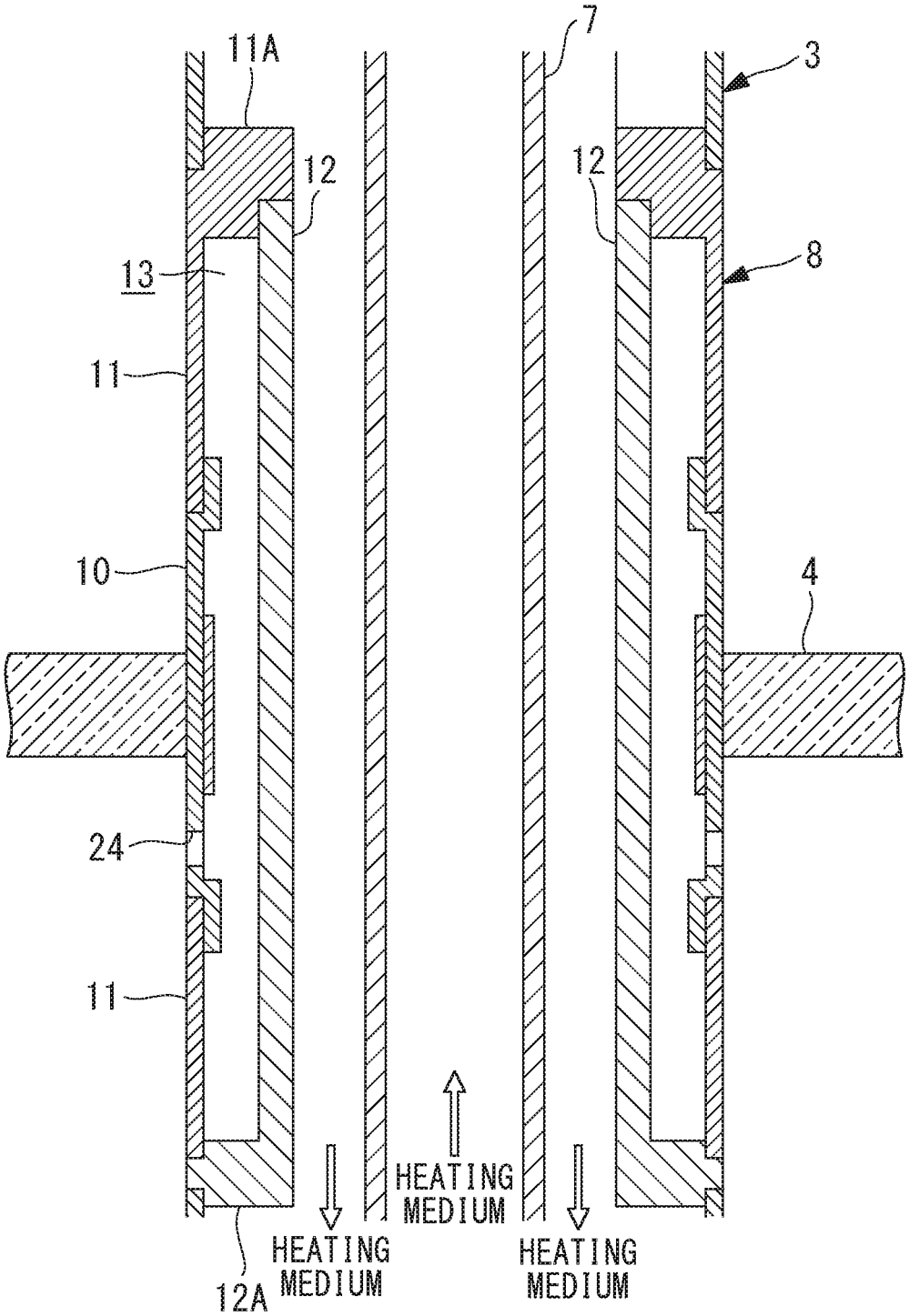
FIG. 3 is a partial enlarged longitudinal sectional view showing a modification of the input coupler according to the embodiment of the present invention.

Although a case where the bellows 14 is formed in each of the low thermally conductive parts 11 is described in the aforementioned embodiment, the present invention is not limited to this example. Specifically, as shown in FIG. 3, the low thermally conductive parts 11 may be merely cylindrical surfaces that are different from bellows 14 in not having a plurality of bending shapes.

A cylindrical part 19 surrounding the external conductor 2 and annular parts 20 provided at respective ends of the cylindrical part 19, for example, are provided on a part at which the external conductor 2 and the second plate 5 are connected. The annular parts 20 are provided to extend in the radial direction from the outer peripheral surface of the external conductor 2. A through-hole 22 through which air or water flows is formed in the cylindrical part 19, and a space 21 defined by the outer peripheral surface of the external conductor 2, the cylindrical part 19, and the annular parts 20 is filled with the air. The cylindrical part 19 is placed along the external conductor 2 and the annular parts 20 are connected to the outer surface of the external conductor 2, and thereby the part at which the external conductor 2 and the second plate 5 are connected is reinforced.

In the part at which the internal conductor 3 and the second plate 5 are connected, a cylindrical part 23 surrounding that part is placed along the inner surface of the internal conductor 3. The cylindrical part 23 is connected to the inner surface of the internal conductor 3, and thereby the part at which the internal conductor 3 and the second plate 5 are connected is reinforced. A through-hole 25 is formed in the cylindrical part 23, and the heating medium can circulate in a space 26 defined by the cylindrical part 23 and inner peripheral surface of the internal conductor 3.

As described above, according to the embodiment, during operation of the superconducting accelerating system, when the accelerating cavity 31 and the first plate 4 are cooled; radio frequency waves are propagated from the waveguide 33 to the input coupler 1; and the internal conductor 3 generates heat, heat transfer between the first plate 4 and the internal conductor 3 is reduced by the heat insulating part 8, and the first plate 4 and the internal conductor 3 are thermally insulated.

As a result, it is possible to prevent the temperature of the internal conductor 3 from becoming the freezing point of heating medium such as water or lower due to the first plate 4 cooled from the external conductor 2 side. Accordingly, even when water is used as the heating medium circulating in the internal conductor 3, it is possible to reduce or eliminate water freezing inside the internal conductor 3.

It is also possible to prevent heat generated in the internal conductor 3 from being transferred to the first plate 4 and the external conductor 2 by the heat insulating part 8. Accordingly, since temperatures of the accelerating cavity 31 and the external conductor 2 are difficult to rise, a heat loss hardly occurs, and the amount of energy required to cool the accelerating cavity 31 and the external conductor 2 can be reduced.

Thus, it is possible to cool the internal conductor 3 even when the radio frequency power is several tens of kW to substantially 100 kW of continuous wave radio frequency power.

REFERENCE SIGNS LIST

1 input coupler
2 external conductor
3 internal conductor
4 first plate
5 second plate
6 flange
7 circulation tube
8 heat insulating part
9 jacket part
10 connection part
11 low thermally conductive part
12, 15, 19, 23 cylindrical part
13, 17, 21, 26 space
14 bellows
16, 20 annular part
18, 22, 24, 25 through-hole

The invention claimed is:

1. An input coupler for an accelerating cavity, comprising:
a cylindrical external conductor;
a cylindrical internal conductor arranged coaxially with the external conductor, inside of which a heating medium circulates;
a plate provided between an inner surface of the external conductor and an outer surface of the internal conductor;
a cooling part for cooling the plate from the external conductor side to the freezing point of water or lower; and
a heat insulating part provided on a part at which the internal conductor and the plate are connected, the heat insulating part having a lower thermal conductivity than that of the internal conductor,
wherein the plate is connected to the internal conductor via the heat insulating part.

2. The input coupler for the accelerating cavity according to claim 1,
wherein the heat insulating part includes a vacuum insulation structure internally kept in vacuum.

3. The input coupler for the accelerating cavity according to claim 1,
wherein the heat insulating part includes a bellows provided between the plate and the internal conductor.

4. The input coupler for the accelerating cavity according to claim 1, further comprising a second plate provided between the inner surface of the external conductor and the outer surface of the internal conductor, the second plate being different from the plate,
wherein a space between the plate and the second plate is kept in vacuum.

5. An accelerator comprising an accelerating cavity provided with the input coupler for the accelerating cavity according to claim 1.

* * * * *